US012760456B2

(12) United States Patent
Ehl et al.

(10) Patent No.: US 12,760,456 B2
(45) Date of Patent: Oct. 13, 2026

(54) METHOD FOR PRODUCING AIR-LAID PRODUCTS

(71) Applicant: Voith Patent GmbH, Heidenheim (DE)

(72) Inventors: Thomas Ehl, Mengen (DE); Jonas Bergström, Ulm (DE)

(73) Assignee: Voith Patent GmbH, Heidenheim (DE)

( * ) Notice: Subject to any disclaimer, the term of this patent is extended or adjusted under 35 U.S.C. 154(b) by 247 days.

(21) Appl. No.: 18/406,977

(22) Filed: Jan. 8, 2024

(65) Prior Publication Data

US 2024/0141568 A1 May 2, 2024

Related U.S. Application Data

(63) Continuation of application No. PCT/EP2022/068516, filed on Jul. 5, 2022.

(30) Foreign Application Priority Data

Jul. 8, 2021 (DE) ..... 10 2021 117 638.7

(51) Int. Cl.
*D04H 1/732* (2012.01)
*D04H 1/26* (2012.01)
(Continued)

(52) U.S. Cl.
CPC ..... *D04H 1/732* (2013.01); *D04H 1/26* (2013.01); *D21B 1/028* (2013.01); *D21F 9/00* (2013.01); *D21G 9/0027* (2013.01)

(58) Field of Classification Search
CPC ..... D04H 1/732; D04H 1/26; D21B 1/028; D21F 9/00; D21G 9/0027
See application file for complete search history.

(56) References Cited

U.S. PATENT DOCUMENTS 3,645,456 A 2/1972 Grafstrom et al.
4,397,713 A * 8/1983 Lambrecht ..... D21B 1/32 162/4
(Continued)

FOREIGN PATENT DOCUMENTS

CN 102599633 A 7/2012
CN 104250875 A 12/2014
(Continued)

OTHER PUBLICATIONS

German Office Action dated Feb. 2, 2022 for German Patent Application No. 10 2021 117 638.7 (10 pages).
(Continued)

*Primary Examiner* — Emmanuel S Luk
(74) *Attorney, Agent, or Firm* — TAYLOR & EDELSTEIN, PC

(57) ABSTRACT

A method for producing an air-laid product or a non-woven product from a starting material includes: comminuting starting material into a comminuted material in at least one comminution line by at least one comminuting device; feeding the comminuted material into at least one material buffer; removing the comminuted material from the at least one material buffer; metering the comminuted material by at least one metering device; supplying the comminuted material to at least one processing line with at least one defibration system in which the comminuted material is defiberized into a defiberized material; and feeding the defiberized material into a production machine and processing the defiberized material into an air-laid product or a non-woven fabric. The at least one metering device is controlled in such a way that a continuous mass flow of defiberized material is supplied to the production machine.

20 Claims, 3 Drawing Sheets

(51) Int. Cl.

| | |
|---|---|
| ***D21B 1/02*** | (2006.01) |
| ***D21F 9/00*** | (2006.01) |
| ***D21G 9/00*** | (2006.01) |

(56) References Cited

U.S. PATENT DOCUMENTS

| | | | | |
|---|---|---|---|---|
| 4,640,810 | A * | 2/1987 | Laursen | D04H 1/732 264/518 |
| 5,150,502 | A * | 9/1992 | Roberson | D01G 23/02 19/303 |
| 5,352,258 | A * | 10/1994 | DeGreve | C03B 3/00 65/135.9 |
| 8,562,879 | B2 * | 10/2013 | Frost | C04B 35/6224 264/122 |
| 8,834,759 | B2 * | 9/2014 | Lalouch | D04H 1/4209 264/115 |
| 9,849,634 | B2 | 12/2017 | Ueno | |
| 10,253,456 | B2 * | 4/2019 | Seki | D21F 9/02 |
| 10,428,466 | B2 * | 10/2019 | Higuchi | D21H 21/06 |
| 10,858,783 | B2 * | 12/2020 | Oguchi | D21G 9/0009 |
| 11,008,707 | B2 * | 5/2021 | Yoda | D21H 21/06 |
| 11,059,199 | B2 | 7/2021 | Watarai et al. | |
| 11,305,461 | B2 | 4/2022 | Abe et al. | |
| 11,390,992 | B2 * | 7/2022 | Oguchi | D21D 1/20 |
| 11,459,703 | B2 * | 10/2022 | Higuchi | D21H 27/42 |
| 11,661,702 | B2 | 5/2023 | Motohashi et al. | |
| 11,891,722 | B2 * | 2/2024 | Gomi | B01F 33/404 |
| 2003/0089478 | A1 | 5/2003 | Tanner et al. | |
| 2003/0092813 | A1 * | 5/2003 | Blenke | C09J 123/12 524/425 |
| 2004/0235631 | A1 | 11/2004 | Buhl et al. | |
| 2013/0005209 | A1 * | 1/2013 | Andersen | D04H 1/732 442/353 |
| 2013/0300015 | A1 * | 11/2013 | Baroux | B29C 43/003 425/200 |
| 2015/0266203 | A1 * | 9/2015 | Santamaria | B27N 3/04 425/447 |
| 2015/0330001 | A1 * | 11/2015 | Coates | D04H 1/732 264/103 |
| 2016/0068681 | A1 * | 3/2016 | Ueno | C08L 91/06 524/277 |
| 2016/0229129 | A1 * | 8/2016 | Ueno | B29B 7/38 |
| 2016/0332325 | A1 * | 11/2016 | Murayama | D21F 9/00 |
| 2016/0333521 | A1 * | 11/2016 | Gomi | D21F 11/00 |
| 2019/0062996 | A1 | 2/2019 | Yoda et al. | |
| 2019/0352851 | A1 * | 11/2019 | Kemper | B32B 7/12 |
| 2021/0060820 | A1 | 3/2021 | Abe et al. | |
| 2021/0230802 | A1 * | 7/2021 | Yamagami | D21F 9/00 |
| 2021/0372047 | A1 | 12/2021 | Oguchi | |
| 2024/0153778 | A1 | 5/2024 | Iwasaki et al. | |

FOREIGN PATENT DOCUMENTS

| | | | | |
|---|---|---|---|---|
| EP | 2501780 | B1 * | 12/2016 | C09K 21/02 |
| EP | 3450125 | A1 | 3/2019 | |
| JP | 2016160562 | A * | 9/2016 | D21B 1/06 |
| JP | 2019-210574 | A | 12/2019 | |
| TW | I715836 | B * | 1/2021 | D21D 1/00 |

OTHER PUBLICATIONS

Notification of the Transmission of the International Search Report and Written Opinion of the International Search Authority or Declaration dated Nov. 21, 2022 for International Application No. PCT/EP2022/068516 (13 pages).

"Massenstrom", Wikipedia, Mar. 31, 2026, https://de.wikipedia.org/wiki/Massenstrom (2 pages).

Peter Schnell, Email regarding "Quote for bale opening and defibration", Feb. 23, 2021, 2 pages.

"CTMP bale opening and defibration system" Dan-Web Machinery A/S proposal dated Feb. 24, 2021 (18 pages).

Preliminary layout drawing for "CTMP bale opening and defibration system" Dan-Web Machinery A/S proposal dated Feb. 24, 2021 (2 pages).

"JesBuffer—Advanced weighers and weighing systems for static, dynamic and continuous weighing", Jesma weighing solutions, Mar. 2018 (4 pages).

UFFE Sudergaard, Email regarding "SV: Information om vejeband", Apr. 14, 2026 (2 pages).

"Affidavit of Peter Schnell", Apr. 15, 2026 (1 page).

"Baled Pulp Processing System", Dan-Web proposal dated Jan. 26, 2006 (10 pages).

Preliminary layout drawing for "Baled Pulp Processing System", Dan-Web proposal dated Jan. 10, 2006 (1 page).

Consolidated list of cited opposition documents, filed Apr. 15, 2026, with the European Patent Office (1 page).

* cited by examiner

METHOD FOR PRODUCING AIR-LAID PRODUCTS

CROSS REFERENCE TO RELATED APPLICATIONS

This is a continuation of International Patent Application No. PCT/EP2022/068516 entitled "METHOD FOR PRODUCING AIRLAID PRODUCTS", filed on Jul. 5, 2022, which is incorporated in its entirety herein by reference. International Patent Application No. PCT/EP2022/068516 claims priority to German Patent Application No. 10 2021 117 638.7 filed on Jul. 8, 2021, which is incorporated in its entirety herein by reference.

BACKGROUND OF THE INVENTION

1. Field of the Invention

The invention relates to a method and to a device for producing an air-laid product or a nonwoven fabric from a starting material, in particular from a pulp material in the form of bundles, for example cellulose bales.

2. Description of the Related Art

Methods and devices of this type are essentially known. Typically, pulp materials, known as fluff pulp, are used. The fluff pulp is delivered in rolls, whereby a fluff pulp web wound into a roll not only has a defined thickness and a defined width, but also additional well defined properties that enable trouble-free further processing. For example, the fluff pulp usually has a high degree of purity, a uniform density of for example less than 0.65 g/cm$^3$ and a uniform moisture content and can be defibrated very well in a dry state, also known as defibration. This is particularly relevant as the production of nonwovens and dry-laid products, especially air-laid products, is usually carried out without the addition of water or other solvents, in other words "dry". Fluff pulp material in rolls is characterized by good running properties, low comminution energy consumption and low knot content. Generally, the fluff pulp material used is already prepared according to the desired material properties and has a desired fiber composition, for example a certain long and short fiber content.

In the manufacture of nonwoven fabrics and dry-laid products from fluff pulp material, the roll material is usually unwound at a defined web speed, fed to the dry defibration process and then to a nonwoven or dry-laid machine (production machine). There is no need to prepare the fluff pulp material beyond defibration, as the roll material used already has the properties required for further processing. It is characteristic of the known manufacturing process that during unwinding of the fluff pulp material from the material roll at a constant web speed, a continuous, in particular temporally constant, mass flow of pulp material is generated due to the well-defined properties of the fluff pulp web, which is also continuously fed to the production machine. The mass flow is adjusted via the web speed during unwinding of the fluff pulp material. Ultimately, the basis weight of the nonwoven or dry-laid product is also set via the mass flow of the material fed to the production machine.

These special requirements for the starting material of known manufacturing processes and devices for air-laid products or nonwovens make the use of conventional pulp materials in commercially available bundles, as used in a wide variety of wet-laid paper types, for example in tissue production, practically impossible. Typically, pulp is available in the form of a pulp bale, which is made up of pulp mats stacked on top of each other. Compared to fluff pulp material, pulp bales have a significant cost advantage. However, pulp bales, or pulp materials in general, which are not supplied in rolls with defined dimensions and defined density, cannot be processed directly into the required continuous mass flow of defiberized pulp material. In addition to defiberizing, further processing steps are necessary, for example cleaning and/or sorting, which can also disrupt the continuous flow of defibrated pulp material.

What is needed in the art is a way to provide a method and a device to produce an air-laid product or a nonwoven fabric which offers greater profitability and a more flexible usability.

SUMMARY OF THE INVENTION

In some embodiments provided according to the invention, a method for producing an air-laid product or a nonwoven product from a starting material includes: comminuting starting material into a comminuted material in at least one comminution line by at least one comminuting device; feeding the comminuted material into at least one material buffer; removing the comminuted material from the at least one material buffer; metering the comminuted material by at least one metering device; supplying the comminuted material to at least one processing line with at least one defibration system in which the comminuted material is defiberized into a defiberized material; and feeding the defiberized material into a production machine and processing the defiberized material into an air-laid product or a non-woven fabric. The at least one metering device is controlled in such a way that a continuous mass flow of defiberized material is supplied to the production machine.

In some embodiments provided according to the invention, a device for producing an air-laid product or a nonwoven fabric from at least one starting material includes: at least one comminution line with at least one comminuting device for comminuting at least one starting material into at least one comminuted material; at least one material buffer for receiving a comminuted material respectively assigned to the at least one material buffer, the at least one material buffer including at least one controllable metering device for metered removal of the respectively assigned comminuted material from the at least one material buffer and for feeding the at least one comminuted material to at least one processing line, the at least one processing line including at least one defibration system that is configured to defiberize the at least one comminuted material into at least a defiberized material; a production machine configured to produce an air-laid product or a nonwoven fabric from the at least one defiberized material; and a control unit configured to control the at least one metering device in such a way that a continuous mass flow of defiberized material is fed to the production machine.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention and such exemplifications are not to be construed as limiting the scope of the invention in any manner.

DETAILED DESCRIPTION OF THE INVENTION

Figure 1:
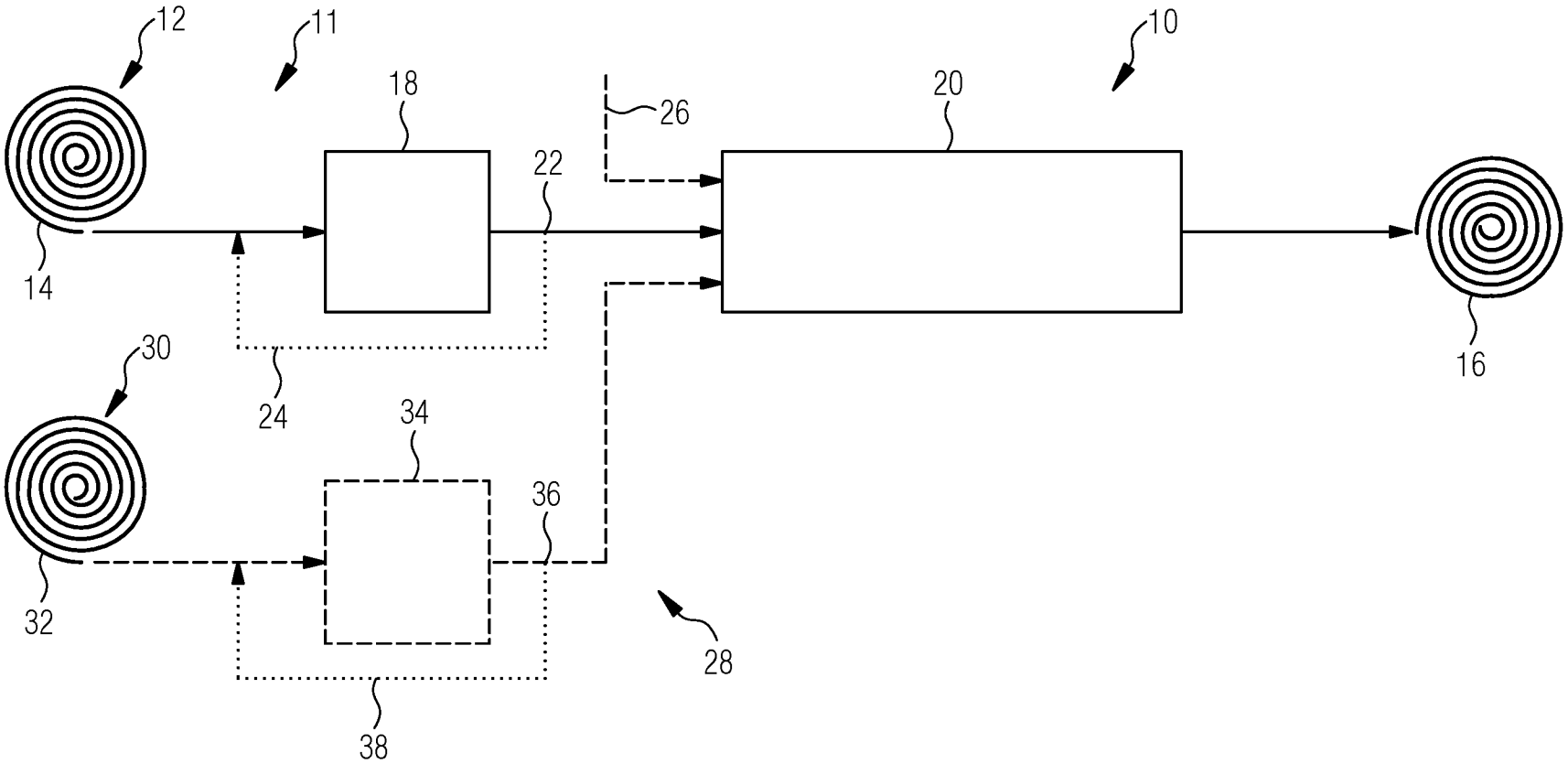
PRIOR ART Fig.1
FIG. 1 is a schematic representation of a manufacturing device for a nonwoven fabric or an air-laid product from fluff pulp material according to the state of the art.

In the method for producing an air-laid product or a nonwoven fabric from a starting material, in particular from a pulp material in the form of a bundle, for example a pulp bale, provided according to the invention, the starting material is comminuted into a comminuted material in at least one comminution line by at least one comminuting device, and the comminuted material is fed to at least one material buffer. The comminuted material is removed in a metered manner from the at least one material buffer, by at least one metering device and is supplied to at least one processing line with at least one defibration system in which the comminuted material is defiberized into a defiberized material. The defiberized material is fed into a production machine and processed into an air-laid product or nonwoven product. The at least one metering device is controlled in such a way that a continuous mass flow of defiberized material is supplied to the production machine.

A device for the production of an air-laid product or a nonwoven fabric from at least one starting material, in particular from a pulp material in the form of a bundle, for example a pulp bale, includes at least one comminution line with at least one comminuting device for comminuting at least one starting material into at least one comminuted material. In addition, the device shall comprise at least one material buffer for receiving a comminuted material respectively assigned to the material buffer, wherein the at least one material buffer includes at least one controllable metering device for metered removal of the respectively assigned comminuted material from the at least one material buffer and for feeding at least one comminuted material to at least one processing line. The at least one processing line includes at least one defibration system that is designed to defiberize the at least one comminuted material into at least defiberized material. The device also includes a production machine to produce an air-laid product or a nonwoven fabric from the at least one defiberized material, wherein a control unit is provided which is equipped and designed to control at least one metering device in such a way that a continuous mass flow of defiberized material is fed to the production machine. With the device provided according to the invention, a manufacturing process provided according to the invention can be carried out.

The invention provides that—in a first process step—before defibrating, a starting material is initially comminuted into a comminuted material by a comminuting device and introduced into a material buffer, for example a bunker, in which the comminuted material is temporarily stored, so to speak. In a second step the comminuted material is fed from the material buffer into the defiberizing process and the production machine.

The first process step, upstream from deberizing, from comminuting of the starting material to feeding of the comminuted material to the material buffer, renders the inventive manufacturing process for nonwovens or air-laid products independent of the use of the cost-intensive fluff pulp material in roll form and instead permits the use of starting materials in any commercially available bundles. For example, pulp bales can be used. In addition to costs, this can also save energy, as the low density of fluff pulp material requires greater thermal drying in its production compared to conventional pulp material such as pulp bales. Similarly, these advantages are achieved by the device provided according to the invention, in particular by providing at least one comminution line and at least one material buffer with at least one metering device.

The pulp bales used are made up of several individual stable and compacted pulp material sheets, which are stacked and bundled to form a bale. The pulp bales differ from the generally often used cotton bales in that the cotton bales fall apart very easily and require only a small fraction of defiberizing.

The pulp material sheets used usually have a basis weight of more than or equal to 400 g/m$^3$, in particular greater than or equal to 600 g/m$^2$, optionally less than or equal to 1200 g/m$^3$. The sheets are very stable and require comminuting equipment adapted to these properties for defiberizing.

The process and the device can be used not only for pulp materials, but more generally for any starting material that can be dry-defiberized, especially regardless of the bundle shape. The starting material can, for example, be introduced into the process or device loose, lightly pressed, or in roll form. For example, waste paper and/or production reject material can be processed in the manner described.

Air-laid products, can include dry-laid products from the group: tissue webs, wipes, towels, napkins, tablecloths, paper webs, writing and printing papers, etc. Nonwovens can include dry-laid products from the group: wipes, towels, napkins, tablecloths, etc. The products of the aforementioned groups are to be understood as examples only and represent only an incomplete list.

In a first process step, the starting material is comminuted into a comminuted material with a certain maximum unit size, which can be stacked and metered in particular and is stacked in a material buffer or temporarily stored in another form. The material buffer, for example a bunker, may be advantageously designed or dimensioned in such a way that the process steps preceding stacking or interim storage of the comminuted material can be carried out independently of the process steps following stacking or interim storage of the comminuted material. This makes batch operation possible in the comminution line or respectively, in the first stage of the process, in which a stock of comminuted material is created in the material buffer.

In the second process step following stacking or interim storage, the comminuted material is defiberized and fed to the production machine, which typically operates continuously. Therefore, a continuous, especially temporally constant mass flow of defiberized material is required to obtain a uniform air-laid product or nonwoven fabric. According to the invention, the provision of a continuous mass flow of defiberized material is made possible by the fact that the discharge of the comminuted material from the at least one material buffer is metered by at least one metering device, in particular in a controlled or regulated manner. At least one metering device can feed a defined amount of comminuted material to a processing line per unit of time.

In some embodiments, all steps of the process for the production of a nonwoven or air-laid product are carried out on a continuous production line. All components of a device for the production of an air-laid product or a nonwoven fabric can thus be combined in a common production line. In this case, there is no provision for the transport of material separate from the continuous production line or for production of additional intermediate products on processing lines other than in the continuous production line.

The metering device can be controlled, in particular by the control unit, on the basis of a characteristic parameter of the mass flow of defiberized material recorded by a sensor. The mass flow of defiberized material is particularly relevant in relation to the air-laid material or nonwoven fabric, as it corresponds directly to the amount of material to be processed by the production machine. For example, the at least one processing line may have a sensor device in or downstream of the defibration system that determines the mass flow of the defiberized material—especially visually—before it is fed into the production machine. Based on the determined mass flow of defiberized material, the amount of comminuted material discharged from the material buffer by the metering device can be adjusted to generate the desired mass flow of defiberized material.

According to some embodiments, the metering device, is controlled in particular by the control unit on the basis of a characteristic parameter of the manufactured air-laid or nonwoven fabric recorded by a sensor, in particular where the parameter is a basis weight. In this case, the amount of comminuted material discharged is directly regulated on the basis of a characteristic of the manufactured air-laid product or nonwoven, wherein its quality or homogeneity is improved in a targeted manner.

The metering device can also be controlled in such a way that a continuous mass flow of comminuted material is supplied to a processing line assigned to the metering device. If, with this approach and the design of the production line, it can be assumed that the continuous mass flow that is fed to the processing line also leads to a continuous mass flow to the production machine—quasi "automatically"—it may be possible to dispense with further complex sensor technology or control technology, since only a corresponding control of the metering device is required.

In particular, to produce a multi-ply product with at least two plies of an air-laid product or nonwoven fabric, the comminuted material can be removed in a metered manner by at least two metering devices from a material buffer assigned to the at least two metering devices and fed to at least two processing lines, each with a defibration system in which the comminuted material is defiberized to create the defiberized material. Each of the at least two metering devices can be assigned to one of the at least two processing lines. The defiberized material from the at least two processing lines can be fed to the same production machine and processed therein to form an air-laid product or nonwoven fabric, in particular a multi-ply product. In principle, more than two metering devices can also be assigned to one material buffer, wherein each metering device of the material buffer is provided for feeding a processing line. A processing line can, for example, be used to prepare the material of a product layer for an air-laid product or a nonwoven fabric that is to be produced.

If present, at least two metering devices of one material buffer can be controlled independently of each other. In this way, at least two different processing lines, each of which is assigned to one of at least two metering devices, can be supplied independently of each other with defined volumes of comminuted material from the material buffer, especially volumes differing from each other. For example, different product layers of an air-laid product or nonwoven material can be produced in this way.

At least two different starting materials, in particular pulp materials, may be used in the process and/or in the device. For example, depending on the product requirement and the requirements of the production machine, long fiber pulp, short fiber pulp, reject material and/or other starting materials can be used. The at least two different starting materials can be introduced into the process or device in separate, material-specific bundles or in bundles that already contain a mixture of materials.

According to some embodiments, the at least two different starting materials are comminuted by the same comminution line or comminuting device, in particular separately, to form at least two comminuted materials that are different from one another. The comminution of the at least two different starting materials can, for example, take place successively by the same comminuting device.

According to some embodiments, the at least two different starting materials are comminuted into at least two different comminuted materials by at least two comminution lines or comminuting devices. A device or production line for manufacturing a nonwoven or air-laid product can have two different comminuting devices or comminution lines for this purpose. These can have different specifications, each of which is particularly suitable for certain starting materials. In this way, a high comminution quality of the at least two different comminuted materials can be ensured.

Each of the at least two comminuted materials, which are different from each other, can be fed into a separate material buffer. The different comminuted materials can be stored or stacked separately from each other in their own material buffers and can be retrieved separately from them.

According to some embodiments, each processing line can be supplied with a defined material composition consisting of at least two different comminuted materials from at least two material buffers by metering devices assigned to them respectively. The at least two comminuted materials, which are different from each other, can be defiberized together by the defibration system of the processing line, whereby the at least two comminuted materials are mixed to form a homogeneous defiberized material. Different comminuted materials from different material buffers can be freely mixed together at any desired proportions by controlling the metering devices of the material buffers accordingly, in particular by the control unit.

In principle, any number of comminution lines, any number of material buffers, and any number of processing lines can be combined with defibration systems independently of each other to create the desired device or production line. This provides an extremely flexible manufacturing process that can be adapted to a wide range of product requirements, which can be configured according to the required production volume, the pulp material used and the capacity of the individual machines. If a multi-ply product is manufactured, the flexibility of the process also allows for a different material composition of the individual product layers.

The at least one starting material can be comminuted and/or defiberized at least substantially dry by at least one comminuting device, in particular without the addition of water or solvents. In particular, provision may be made that the moisture content of the starting material, the comminuted material and/or the defiberized material during the manufacturing process does not exceed a value of 10%, in particular a value of 8% or 7%.

According to some embodiments, at least one comminuted material is sorted according to a characteristic parameter, in particular by a screen and/or a cyclone separator. Alternatively or in addition, the at least one defiberized material can be sorted according to a characteristic parameter, in particular by a screen and/or a cyclone separator. The characteristic parameter can for example be a unit size of the comminuted or defiberized material, whereby material that exceeds a maximum unit size is screened out and, if necessary, fed back into comminuting or defiberizing. This ensures great homogeneity of the comminuted and/or defiberized material, which has a positive effect on the subsequent process steps and ultimately on the quality of the nonwoven fabric or air-laid product produced.

According to some embodiments, the at least one comminuted material is cleaned, in particular by a cyclone separator and/or a magnetic separator. Alternatively or additionally, the at least one defiberized material can be cleaned, in particular by a cyclone separator and/or a magnetic separator. Impurities, such as metallic contaminants, and/or heavy parts can be removed from the comminuted and/or defiberized material in order to obtain a clean and homogeneous comminuted and/or defiberized material.

According to some embodiments, a material buffer is suitable for holding at least one, optionally two, supplied bundles of pulp material, in particular one, optionally two pulp bales. Advantageously, the material buffer is designed in such a way that a buffering of at least one, optionally two, entire pulp bales is possible in order to bridge the changeover times during the discontinuous feeding of the bales. The buffer size is decisive for continuous operation of the downstream production machine.

According to some embodiments, a material buffer is arranged after a comminuting device of the pulp material and before a defibration system in such a way that buffering before the defibration system and continuous operation of the defibration system, optionally a hammer mill, is made possible. This is advantageous for the service life of the defibration systems used, optionally hammer mills, whose wear and tear is less with continuous feeding, and also for continuous quality, because in discontinuous operation, differences can occur in the first and last defiberized pulp materials.

According to some embodiments, the pulp material used has a basis weight of greater than or equal to 400 g/m$^3$, in particular greater than or equal to 600 g/m$^2$, optionally less than or equal to 1200 g/m$^3$. Advantageously, the necessary volumes of starting material can be stored in a space-saving manner. However, the high basis weight also places special demands on the comminuting devices used.

According to some embodiments, the production machine of an air-laid product or a nonwoven fabric is a paper and/or tissue machine.

According to some embodiments, the starting material is provided only by pulp bales. Advantageously, no expensive rolls products are used.

Referring now to the drawings, FIG. 1 shows a schematic representation of a device 10 according to the state of the art for the manufacture of an air-laid product or a non-woven fabric 16 from fluff pulp material, which is provided in the form of a fluff pulp web 14 wound into a material roll 12. The fluff pulp is unwound from material roll 12 at a defined web speed and is fed to a processing line 11 which is equipped with a defibration system system 18, in which fluff pulp web 14 is defiberized. The defiberized pulp material is subsequently fed into a production machine 20, in which it is used to produce an air-laid product or a nonwoven fabric 16.

Since fluff pulp web 14 has defined dimensions and a uniform density, unwinding of fluff pulp web 14 from material roll 12 at a defined web speed provides a continuous material flow with a constant mass flow of fluff pulp in device 10, which is fed into continuously operating production machine 20. The mass flow of defiberized pulp material can be detected by a sensor device 22 between defibration system 18 and production machine 20. If the measured mass flow deviates from a target mass flow, the mass flow can be adjusted to the target mass flow by adjusting the web speed during unwinding of fluff pulp web 14 from material roll 12 (Control 24).

Optionally, production machine 20 can be fed with additional materials, which is shown with dashed lines in FIG. 1 to emphasize its optional character. On the one hand, one or more already processed materials 26 can be fed into production machine 20 together with the pulp material defiberized by defibration system 18. On the other hand, device 10 may comprise a second processing line 28 on which a second fluff pulp web 32 is unwound from a second material roll 30 and fed to a second defibration system 34 at a defined web speed, creating a continuous mass flow of a second defiberized material. This can also be fed to production machine 20, whereby also in second processing line 28 an adjustment 38 of the web speed can be carried out as described above by a second sensor device 36.

Device 10 according to the state of the art requires the use of fluff pulp webs 14, 32 in the form of defined unwindable material rolls 12, 30, as this is the only way to ensure that a continuous mass flow of fluff pulp is fed to production machine 20.

Figure 2:
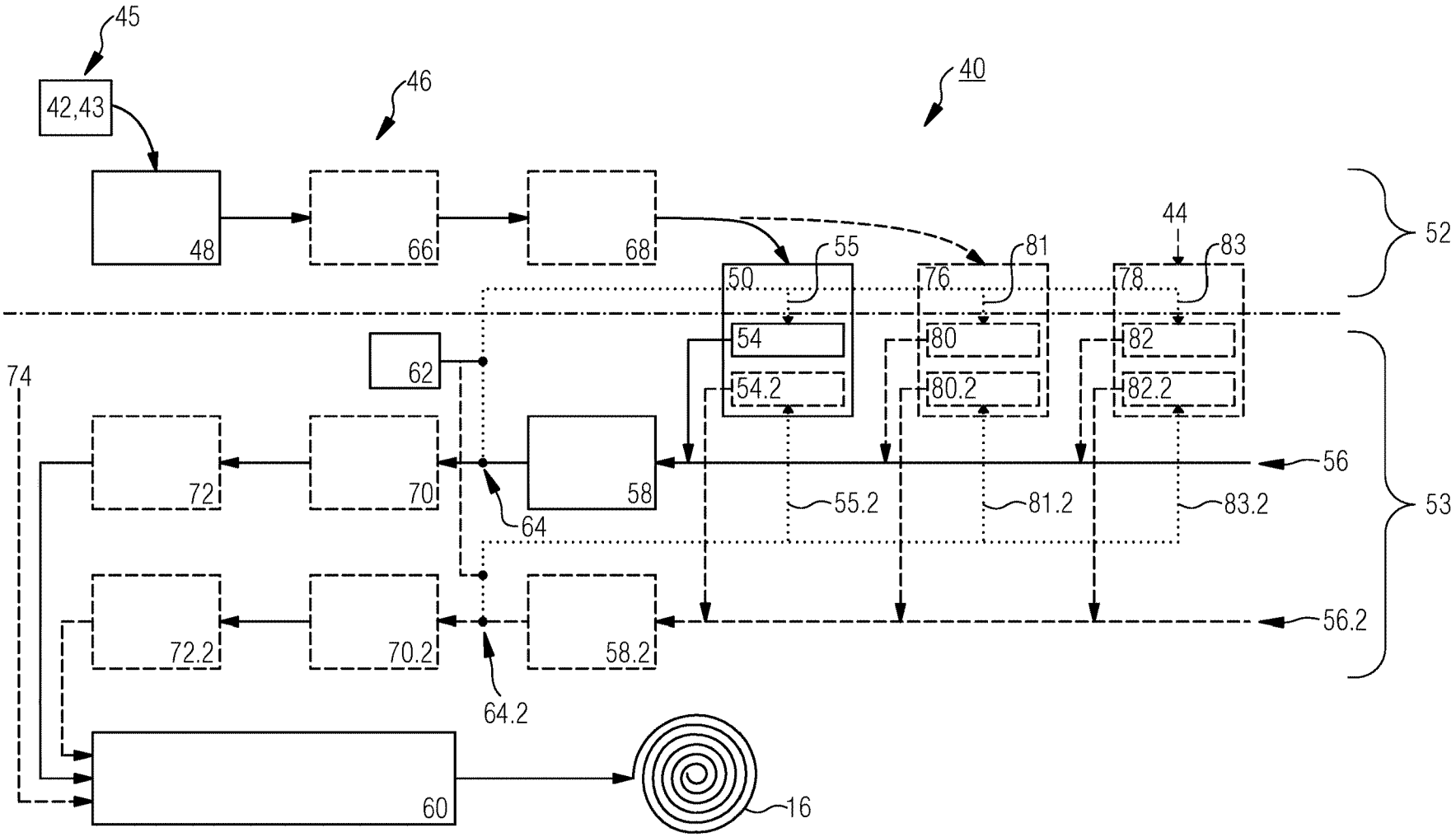
FIG. 2 is a schematic representation of an embodiment of a manufacturing device provided according to the invention for a nonwoven or an air-laid product from a bale-shaped starting material with a comminution line, at least one material buffer and at least one processing line with a defibration system.

In contrast, a device provided according to the invention is designed and arranged so that a starting material can be used in any desired bundle configuration. FIG. 2 shows a device 40 for the production of an air-laid product or a nonwoven fabric 16 from at least one starting material 42. Essential components of device 40 are illustrated by solid lines; optional components are shown by dashed lines.

According to FIG. 2, all the components or components of device 40 are arranged in a continuous, common production line in which a process for the manufacture of an air-laid product or nonwoven fabric 16 is feasible. In the following, the basic functionality of device 40 and a manufacturing process that can be carried out with device 40 will be explained, initially referring to the basic device components and process steps.

As shown in FIG. 2, the starting material is a pulp material in the form of a pulp bale 45, wherein pulp bale 45 consists of pulp mats stacked on top of each other (not shown). In principle, a starting material 42 can be used in the form of any desired bundle. First, the starting material 42, for example entire pulp bale 45 or part thereof, is fed to a comminution line 46 of device 40, which includes a comminuting device 48 by which starting material 42 is comminuted into a comminuted material. It is provided that starting material 42 will be comminuted dry—without the addition of water.

Comminuting device 48 can for example, comprise a single-shaft or multi-shaft comminuting device. It can be equipped with a screen, which defines a maximum unit size of the comminuted material discharged from comminuting device 48, thus making it at least partially homogenized and meterable. The comminuted material from comminuting device 48 can be discharged, for example, by a conveyor belt, a feed screw or an suction box. Optionally, the discharge is carried out with a suction box or a screw conveyor with assisted suction. The suction prevents dust from accumulating in the area of comminuting device 48. In addition, a rapid discharge of the comminuted material supported by suction has a positive effect on the comminuting quality.

Device 40 includes a material buffer 50, for example a bunker, which is provided to receive the comminuted material. In order to feed the comminuted material to material buffer 50, it can be fed from the discharge of comminuting device 48 into an air duct and be transported by an air flow in the direction of material buffer 50. The air flow can be generated by a transport fan with an open impeller, which is located following the comminuting device, in the material flow of the comminuted material. Alternatively or in addition, a more energy-efficient transport fan with a closed impeller can be provided.

The latter can, in particular, be located downstream of material buffer 50, where the comminuted material has already been separated from the air flow and stacked in material buffer 50 or temporarily stored in another form. To separate the comminuted material from the air flow and/or to temporarily store the comminuted material in material buffer 50, a dedicated cyclone separator and/or a screen separator may be provided.

Material buffer 50 can be dimensioned in such a way that it can hold a larger amount of comminuted material than can be fed to comminuting device 48 at one time. Thus, material buffer 50 enables batch operation in comminution line 46, for example a number of bundles of starting material 42—for example several pulp bales 45—can be comminuted into comminuted material by comminuting device 48, which is then fed to material buffer 50 and, if necessary, temporarily stored in it. In this respect, a first stage of process 52 from comminution of starting material 42 to intermediate storage of the comminuted material in material buffer 50 can be carried out independently of subsequent production steps. This is indicated in FIG. 2 by a dash-dotted line, above which first process section 52 (batch operation) is shown.

A second process phase 53 (continuous or quasi-continuous operation) begins with the removal of the comminuted material from material buffer 50 (FIG. 2, below the dasch-dotted line). For this purpose, material buffer 50 has a controllable metering device 54, by which the comminuted material can be removed—metered—from material buffer 50. Metering device 54 feeds the comminuted material to a processing line 56. Controllable metering device 54 can be designed as a speed-controlled screw conveyor, which manages discharge and metering of the comminuted material which is stacked in material buffer 50 and feeds a controlled mass flow of comminuted material to processing line 56.

Processing line 56 includes a defibration system 58 by which the comminuted material is defiberized into a defiberized material. The resulting defiberized material is subsequently fed to a production machine 60 of device 40, where an air-laid product or non-woven fabric 16 is produced from it. Defibration system 58 can be fed by a conveyor belt, a screw conveyor, or with the help of an air flow. According to some embodiments, the comminuted material is fed by a controllable metering device 54 directly into a duct assigned to processing line 56 and brought to refining system 58 by an air flow generated by a transport fan. With this supply structure, material buffer 50 and defibration system 58 can be positioned spatially independently of each other and can be flexibly connected by the duct of processing line 56. Moreover, due to the high transporting speed of the air flow, a change in metering of the comminuted material fed to processing line 56 by metering device 54 occurs with a very small time delay in defibration system 58 and thus ultimately also in production machine 60, so that a particularly direct control of the production process is possible, which ultimately has a positive effect on the quality of the produced air-laid product or non-woven fabric 16.

Defibration system 58 is designed to defiberize the comminuted material in a substantially dry state without the addition of water. Defibration system 58 can include at least one first hammer mill which defiberizes the comminuted material. In order to achieve improved defiberizing quality, defibration system 58 can also have a second hammer mill downstream of the first hammer mill. The first hammer mill may be equipped with a screen to prevent whole, non-defiberized pieces of comminuted material from leaving the first hammer mill and entering the second hammer mill. The second hammer mill can have narrower and closer-fitting hammers than the first hammer mill, and can remove any knots from the material defiberized by the first hammer mill, which ultimately has a positive effect on the quality of the air-laid product or nonwoven fabric 16 produced.

The dry defiberized pulp material is then fed to production machine 60, for example via a duct system adjoining defibration system 58 by an air flow generated by a transport fan. Production machine 60 may be a conventional continuously operating production machine 60, so that a continuous mass flow of defiberized material must be fed to the latter in order to obtain a uniform air-laid product or a uniform nonwoven fabric 16. In order to achieve this, it is provided that metering device 54 is controlled in such a way that a continuous mass flow of defiberized material is fed to production machine 60. For this purpose, device 40 has a control unit 62 which is arranged and designed to control the controllable metering device 54 in a corresponding manner.

According to FIG. 2, metering device 54 is controlled on the basis of a characteristic parameter of the mass flow of defiberized material between defibration system 58 and production machine 60. To determine the mass flow of defiberized material, a sensor device 64 is arranged directly behind defibration system 58, for example in the duct system, or possibly also after cleaning device 70 and/or after a sorting device 72, which detects the actual mass flow present, for example by a camera system or by other suitable sensors. The actual recorded mass flow serves as a control variable for controllable metering device 54. If it deviates from a target mass flow, metering device 54 is controlled or readjusted (control 55) in order to achieve this target mass flow.

Alternatively, the control of metering device 54 can be carried out on the basis of a characteristic parameter of the manufactured air-laid product or nonwoven fabric 16, for example on the basis of an actual basis weight of the air-laid product or nonwoven fabric 16 recorded by suitable sensor technology. If the actual measured basis weight deviates from a target basis weight, the metering device is controlled or adjusted accordingly in order to provide the processing line with a the appropriate amount of comminuted material and thus achieve the target basis weight. In principle, metering device 54 can be controlled in such a way that a continuous and, in particular, constant, in other words unchanged, mass flow of comminuted material is supplied to processing line 56.

Dashed lines in FIG. 2 show additional optionally provided components of device 40. Comminution line 46 may include a cleaning device 66 downstream of comminuting device 48, for example located in a duct system for transporting the comminuted material. Cleaning device 66 can include a magnetic separator that removes metallic contaminants from the comminuted material. A sorting device 68 can be installed downstream of cleaning device 66, which includes, for example, a cyclone separator that rejects heavy parts before the comminuted, cleaned and sorted material is fed into material buffer 50.

In a similar manner, cleaning device 70 and/or sorting device 72 may be arranged in processing line 56 downstream of defibration system 58 in order to clean the defiberized material from foreign substances and impurities and to sort it, for example with regard to its unit size. For this purpose, a magnetic separator, a cyclone separator and/or a screen separator can be used.

Moreover, device 40 may have an infeed 74 before production machine 60 for other materials that have already been processed. In addition, device 40 may have a second processing line 56.2, which can be fed with comminuted material by a controllable second metering device 54.2 of material buffer 50. Thus, each processing line 56, 56.2 is assigned a separate, controllable metering device 54, 54.2, via which processing lines 56, 56.2 are fed with comminuted material from material buffer 50. Conversely, material buffer 50 has a separate metering device 54, 54.2 for each processing line 56, 56.2. Metering devices 54, 54.2 can be controlled independently of each other, so that each processing line 56, 56.2 can be fed a separately definable amount of comminuted material from material buffer 50.

Analogous to processing line 56, second processing line 56.2 includes a second difiberizing system 58.2 for defiberizing of comminuted material. In addition, a second cleaning device 70.2 and a second sorting device 72.2 may be provided in second processing line 56.2, as described above in connection with first processing line 56. In second processing line 56.2, a second sensor device 64.2 is located directly after second defibration system 58.2 or also after second cleaning device 70.2 or second sorting device 72.2, which records the mass flow of the defiberized material. If the actual measured mass flow deviates from a target mass flow defined for second treatment line 56.2, second metering device 54.2 assigned to second processing line 56.2 is readjusted or controlled on this basis (control 55.2) in order to achieve the target mass flow.

In the production of a multi-ply air-laid product or nonwovens 16, each respective processing line 56, 56.2 may be designed to defiberize starting material 42 for one product layer and feed it to production machine 60. For this purpose, each processing line 56, 56.2 can be fed with the appropriate amount of comminuted starting material by metering device 54, 54.2 respectively assigned to it.

For the production of an air-laid product or nonwoven fabric 16 various materials can be used in particular a second starting material 43 and a third material 44 in addition to starting material 42. For example, long-fiber pulp can be used as starting material 42, short-fiber pulp as second starting material 43, in each case in bale form, and an already comminuted reject material as third starting material 44 (FIG. 2, top right). Device 40 can have a separate material buffer for each of material 42, 43, 44 respectively, in particular a second material buffer 76 for receiving second starting material 43 and a third material buffer 78 for receiving the separately provided, possibly pre-processed reject material 44.

Since long fiber and short fiber pulp bales behave similarly during comminution, they can be comminuted with same comminuting device 48 in comminution line 46 and can be optionally cleaned and sorted using same cleaning device 66, in particular the same magnetic separator, and same sorting device 68, in particular the same cyclone separator. Comminution, cleaning and sorting of starting materials 42, 43 is carried out separately, in other words, for example one after the other, so that the resulting comminuted material comprises only one type of material at a time. In order to deposit each of the different comminuted materials in material buffer 50, 76 assigned to it, a duct system of comminution line 46 can be switched over in such a way that comminuted material from long-fiber pulp 42 is fed to bunker 50 and comminuted material from short-fiber pulp 43 to bunker 76. Already comminuted reject material 44 is fed into third material bunker 78. For stacking respective material 42, 43, 44, each respective material buffer 50, 76, 78 optionally has a cyclone separator and/or a screen separator.

Second and third material buffers 76, 78 can also be equipped with two metering devices 80, 80.2 and 82, 82.2 respectively, each of which is assigned to one processing line 56, 56.2 respectively and can be controlled independently of each other. Control unit 62 can thus be used to supply each of the two processing lines 56, 56.2 independently of each other with a defined material composition of comminuted material consisting of arbitrarily selectable proportions of long fiber pulp 42, short fiber pulp 43 and reject material 44. All comminuted materials supplied to respective processing lines 56, 56.2 are defiberized together in defibration system 58, 58.2 arranged in corresponding processing line 56, 56.2 and thereby intermixed. For example, a multi-ply product—according to FIG. 2 a two-ply air-laid product or nonwoven fabric 16—can be produced with different material compositions of the individual product layers.

By sensor devices 64, 64.2 of two processing lines 56, 56.2 respectively, the mass flow in respective processing line 56, 56.2 can be recorded, as already described above for metering devices 54, 54.2 of material buffer 50. On the basis of the data collected by sensor device 64, metering devices 54, 80, 82 assigned to processing line 56 are readjusted or controlled (control 55, 81, 83). On the basis of the data collected by second sensor device 64.2, metering devices 54.2, 80.2, 82.2 assigned to second processing line 56.2 are readjusted or controlled (control 55.2, 81.2, 83.2).

Figure 3:
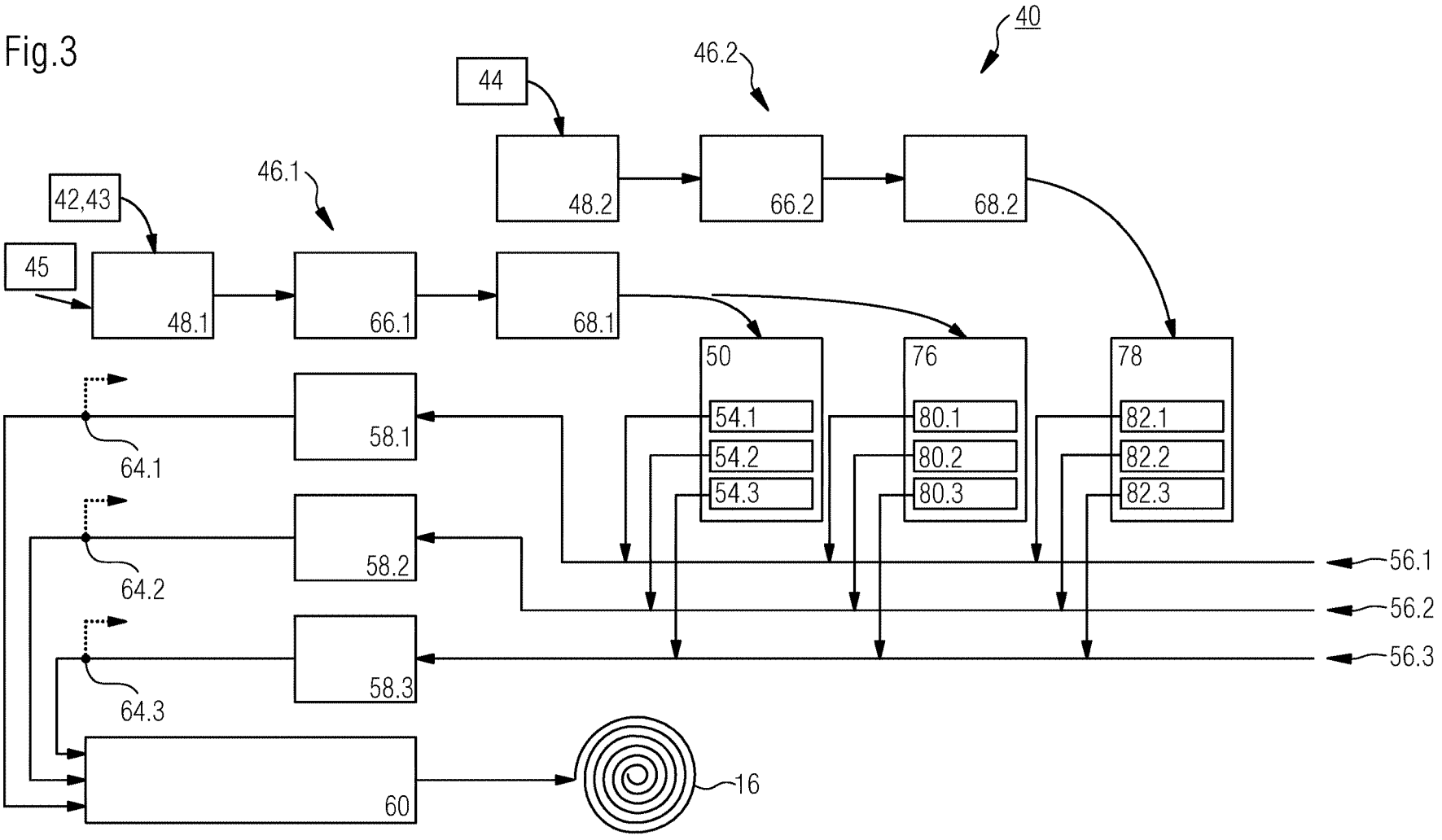
FIG. 3 is a schematic representation of an embodiment of a manufacturing device provided according to the invention for a three-ply nonwoven or a three-ply air-laid product from bale-shaped starting materials with two comminution lines, three material buffers and three processing lines, each with a defibration system.

FIG. 3 shows an additional device 40 for the production of a three-ply air-laid product or nonwoven fabric 16 from three different starting materials 42, 43, 44, each of which is fed into device 40 in bale form. As described in connection with FIG. 2, the material can be long-fiber pulp 42, short-fiber pulp 43 and reject material 44. In order to comminute starting materials 42, 43, 44, device 40 has a first comminution line 46.1 for the long fiber and short fiber pulp materials 42, 43 (see FIG. 2) and a second comminution line 46.2 for reject material 44, each of which comprises a comminution line 48.1, 48.2, a cleaning device 66.1, 66.2 and a sorting device 68.1, 68.2. It may be advantageous to use a separate comminution device 48.2 for reject material 44 as well as a separate magnetic separator and cyclone separator for cleaning and sorting, as this allows adaptation to the requirements of reject material 44 in terms of shape, material properties and production quantity. Thus, long-fiber and short-fiber pulp materials 42, 43 can be comminuted independently of the reject material 44, the comminution quality can be improved for all starting materials 42, 43, 44, and due to the typically lower amount of reject material used, smaller machines can be used in second comminution line 46.2 and thus save energy.

Each of the three comminuted starting materials 42, 43, 44 is fed into a separate material buffer 50, 76, 78. For the production of the three product layers, each of which has an individual material composition, the device has a first, a second and a third processing line 56.1, 56.2, 56.3. Each material buffer 50, 76 and 78 therefore has three independently controllable metering devices, of which a first metering device 54.1, 80.1, 82.1 is provided for supplying first processing line 56.1, a second metering device 54.2, 80.2, 82.2 respectively for feeding second processing line 56.2 and a third dosing device 54.3, 80.3, 82.3 respectively for feeding third processing line 56.3. By a defibration system 58.1, 58.2, 58.3 for each processing line 56.1, 56.2, 56.3, the comminuted material fed to each of them is defiberized and homogeneously intermixed, and then supplied to a production machine 60 for the production of a three-ply air-laid product or nonwovens 16.

Each of the three processing lines 56.1, 56.2, 56.3 has its own sensor device 64.1, 64.2, 64.3, which, as described in connection with FIG. 2 above, is located between respective comminution system 58.1, 58.2, 58.3 and production machine 60 and records the mass flow of defiberized material in respective processing line 56.1, 56.2, 56.3. A comparison of the mass flow actually recorded in each processing line 56.1, 56.2, 56.3 with a target mass flow serves as a basis for controlling each of first metering devices 54.1, 80.1, 82.1, second dosing devices 54.2, 80.2, 82.2 and/or third metering devices 54.3, 80.3, 82.3 respectively, if necessary in such a way that the target mass flow is achieved and a correspondingly continuous, in particular temporally constant, mass flow is supplied to production machine 60.

It is clear from the foregoing that the concept of the invention can be easily adapted to the respective requirement profile. The three processing lines 56.1, 56.2, 56.3 and thus the three layers of the air-laid product or nonwoven fabric 16 can be composed independently of the three materials 42, 43, 44.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

REFERENCE IDENTIFICATION LISTING

10 device according to the state of the art
11 processing line
12 material roll
14 fluff pulp web
16 air-laid product or nonwoven fabric
18 defibration system
20 production machine
22 sensor device
24 control of web speed of first processing line
26 supply of already processed materials
28 second processing line
30 second material roll
32 second fluff pulp web
34 second defibration system
36 second sensor device
38 control of web speed of second processing line
40 device for production of an air-laid product or nonwoven fabric
42 starting material
43 second starting material
44 third starting material
45 pulp bale
46 comminution line
46.1 first comminution line
46.2 second comminution line
48 comminution device
48.1 first comminution device
48.2 second comminution device
50 material buffer
52 first process phase
53 second process phase
54 controllable metering device of material buffer
54.1 first controllable metering device of material buffer
54.2 second controllable metering device of material buffer
54.3 third controllable metering device of material buffer
55 control of metering device of material buffer
55.2 control of second metering device of material buffer
56 processing line
56.1 first processing line
56.2 second processing line
56.3 third processing line
58 defibration system
58.1 first defibration system
58.2 second defibration system
58.3 third defibration system
60 production machine
62 control unit
64 sensor device
64.1 first sensor device
64.2 second sensor device
64.3 third sensor device
66 cleaning device for comminuted material
66.1 cleaning device for comminuted material of the first comminution line
66.2 cleaning device for comminuted material of the second comminution line
68 sorting device for comminuted material
68.1 sorting device for comminuted material of the first comminution line
68.2 sorting device for comminuted material of the second comminution line
70 cleaning device for defiberized material
70.2 second cleaning material for defiberized material
72 sorting device for defiberized material
72.2 second sorting device for defiberized material
74 infeed for additional materials
76 second material buffer
78 third material buffer
80 controllable material device of second material buffer
80.1 first controllable material device of second material buffer
80.2 second controllable material device of second material buffer
80.3 third controllable material device of second material buffer
81 control of metering device of second material buffer
81.2 control of metering device of second material buffer
82 controllable metering device of third material buffer

82.1 first controllable metering device of third material buffer

82.2 second controllable metering device of third material buffer

82.3 third controllable metering device of third material buffer

83 control of metering device of third material buffer

83.2 control of second metering device of third material buffer

What is claimed is:

1. A method for producing an air-laid product or a non-woven product from a starting material, the method comprising:

comminuting starting material into a comminuted material in at least one comminution line by at least one comminuting device;

feeding the comminuted material into at least one material buffer;

removing the comminuted material from the at least one material buffer;

metering the comminuted material by at least one metering device;

supplying the comminuted material, using the at least one metering device, from the at least one material buffer to at least one processing line with at least one defibration system in which the comminuted material is defiberized into a defiberized material;

feeding the defiberized material into a production machine and processing the defiberized material into an air-laid product or a non-woven fabric; and adjusting the at least one metering device supplying the comminuted material to the at least one processing line from the at least one material buffer in such a way that a continuous mass flow of defiberized material is supplied to the production machine.

2. The method of claim 1, wherein all steps of the method are carried out on a continuous production line.

3. The method of claim 1, wherein the at least one metering device is adjusted on the basis of a characteristic parameter of a mass flow of defiberized material recorded by a sensor.

4. The method of claim 1, wherein the at least one metering device is adjusted on the basis of a characteristic parameter of the manufactured air-laid product or nonwoven fabric recorded by a sensor.

5. The method of claim 4, wherein the characteristic parameter of the manufactured air-laid product or nowoven fabric is a basis weight.

6. The method of claim 1, wherein the at least one metering device is adjusted in such a way that a continuous mass flow of comminuted material is supplied to a processing line assigned to the at least one metering device.

7. The method of claim 1, wherein the comminuted material is removed in a metered manner by at least two metering devices from the at least one material buffer assigned to the at least two metering devices and fed to at least two processing lines, each equipped with a defibration system in which the comminuted material is defiberized to create the defiberized material, wherein each of the at least two metering devices is assigned to one of the at least two processing lines, and wherein the defiberized material from the at least two processing lines is fed to the same production machine and processed therein to form a multi-ply air-laid product or nonwoven fabric.

8. The method of claim 1, wherein the at least one metering device comprises at least two metering devices and the at least two metering devices of at least one material buffer can be adjusted independently of each other.

9. The method of claim 1, wherein at least two different starting materials are used.

10. The method of claim 9, wherein the at least two different starting materials are comminuted by the same comminution line or comminuting device to form at least two comminuted materials that are different from one another.

11. The method of claim 10, wherein the at least two different starting materials are comminuted separately.

12. The method of claim 10, wherein each of the at least two comminuted materials, which are different from each other, are fed into a separate material buffer.

13. The method of claim 9, wherein the at least two different starting materials are comminuted by at least two comminution lines or comminuting devices to form at least two comminuted materials that are different from one another.

14. The method of claim 13, wherein each of the at least two comminuted materials, which are different from each other, are fed into a separate material buffer.

15. The method of claim 1, wherein each processing line is supplied with a defined material composition consisting of at least two different comminuted materials from at least two material buffers by metering devices assigned to them respectively.

16. The method of claim 1, wherein the starting material is comminuted and/or defiberized at least substantially dry by the at least one comminuting device without the addition of water or solvents.

17. The method of claim 1, wherein the comminuted material is sorted according to a characteristic parameter by a screen and/or a cyclone separator and/or wherein the defiberized material can be sorted according to a characteristic parameter by the screen and/or the cyclone separator.

18. The method of claim 1, wherein the comminuted material is cleaned by a cyclone separator and/or a magnetic separator; and/or wherein the defiberized material is cleaned by a cyclone separator and/or a magnetic separator.

19. A device for producing an air-laid product or a non-woven fabric from at least one starting material, the device comprising:

at least one comminution line with at least one comminuting device for comminuting at least one starting material into at least one comminuted material;

at least one material buffer for receiving a comminuted material respectively assigned to the at least one material buffer, wherein the at least one material buffer includes at least one controllable metering device for metered removal of the respectively assigned comminuted material from the at least one material buffer and for feeding the at least one comminuted material to at least one processing line, wherein the at least one processing line includes at least one defibration system that is configured to defiberize the at least one comminuted material into at least a defiberized material;

a production machine configured to produce an air-laid product or a nonwoven fabric from the at least one defiberized material; and a control unit configured to adjust the at least one metering device feeding the at least one comminuted material to the at least one processing line from the at least one material buffer in such a way that a continuous mass flow of defiberized material is fed to the production machine.

20. The device of claim 19, wherein all components of the device are arranged in a common production line.

* * * * *